US008548801B2

(12) United States Patent
Kim et al.

(10) Patent No.: US 8,548,801 B2
(45) Date of Patent: Oct. 1, 2013

(54) ADAPTIVE TIME/FREQUENCY-BASED AUDIO ENCODING AND DECODING APPARATUSES AND METHODS

(75) Inventors: Junghoe Kim, Seoul (KR); Eunmi Oh, Seongnam-si (KR); Changyong Son, Gunpo-si (KR); Kihyun Choo, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 1274 days.

(21) Appl. No.: 11/535,164

(22) Filed: Sep. 26, 2006

(65) Prior Publication Data

US 2007/0106502 A1 May 10, 2007

(30) Foreign Application Priority Data

Nov. 8, 2005 (KR) ..... 10-2005-106354

(51) Int. Cl.
*G10L 11/00* (2006.01)

(52) U.S. Cl.
USPC ..... 704/200; 704/500

(58) Field of Classification Search
USPC ..... 704/200, 201, 500, 501
See application file for complete search history.

(56) References Cited

U.S. PATENT DOCUMENTS

| | | | | |
|---|---|---|---|---|
| 5,774,837 | A * | 6/1998 | Yeldener et al. | 704/208 |
| 5,999,897 | A * | 12/1999 | Yeldener | 704/207 |
| 6,334,105 | B1 | 12/2001 | Ehara | |
| 6,584,438 | B1 * | 6/2003 | Manjunath et al. | 704/228 |
| 6,691,082 | B1 | 2/2004 | Aguilar et al. | |
| 6,912,496 | B1 * | 6/2005 | Bhattacharya et al. | 704/228 |
| 7,596,486 | B2 * | 9/2009 | Ojala et al. | 704/201 |
| 2001/0023396 | A1 * | 9/2001 | Gersho et al. | 704/220 |
| 2002/0035470 | A1 | 3/2002 | Gao | |
| 2003/0004711 | A1 * | 1/2003 | Koishida et al. | 704/223 |
| 2003/0195742 | A1 | 10/2003 | Tsushima et al. | |
| 2004/0174984 | A1 | 9/2004 | Jabri et al. | |
| 2005/0065788 | A1 * | 3/2005 | Stachurski | 704/229 |
| 2005/0192797 | A1 | 9/2005 | Makinen | |
| 2006/0173675 | A1 * | 8/2006 | Ojanpera | 704/203 |
| 2006/0271357 | A1 * | 11/2006 | Wang et al. | 704/223 |

FOREIGN PATENT DOCUMENTS

| | | |
|---|---|---|
| WO | 2004070706 | 8/2004 |
| WO | 2005093717 | 10/2005 |

OTHER PUBLICATIONS

D.W. Griffin; Dept. Of Electr. Eng. & Comput. Sci.; Mit; Cambridge; Ma; Usa; J.S. Lim; , "Multiband excitation vocoder," Acoustics, Speech and Signal Processing, IEEE Transactions on , vol. 36, No. 8, pp. 1223-1235, Aug. 1988 URL: http://ieeexplore.ieee.org/stamp/stamp.jsp?tp=&arnumber=1651&isnumber=104.*

Bessette, B.; Salami, R.; Laflamme, C.; Lefebvre, R.; , "A wideband speech and audio codec at 16/24/32 kbit/s using hybrid ACELP/TCX techniques," Speech Coding Proceedings, 1999 IEEE Workshop on , vol., no., pp. 7-9, 1999 URL: http://ieeexplore.ieee.org/stamp/stamp.jsp?tp=&arnumber=781466&isnumber=16956.*

PCT Search Report dated Jan. 31, 2007 issued in KR 2006-4655.

Extended European Search Report issued Jan. 12, 2011 in EP Application 06 81 2491.

* cited by examiner

*Primary Examiner* — Douglas Godbold

(74) *Attorney, Agent, or Firm* — Stanzione & Kim, LLP

(57) ABSTRACT

Adaptive time/frequency-based audio encoding and decoding apparatuses and methods. The encoding apparatus includes a transformation & mode determination unit to divide an input audio signal into a plurality of frequency-domain signals and to select a time-based encoding mode or a frequency-based encoding mode for each respective frequency-domain signal, an encoding unit to encode each frequency-domain signal in the respective encoding mode, and a bitstream output unit to output encoded data, division information, and encoding mode information for each respective frequency-domain signal. In the apparatuses and methods, acoustic characteristics and a voicing model are simultaneously applied to a frame, which is an audio compression processing unit. As a result, a compression method effective for both music and voice can be produced, and the compression method can be used for mobile terminals that require audio compression at a low bit rate.

27 Claims, 8 Drawing Sheets

ADAPTIVE TIME/FREQUENCY-BASED AUDIO ENCODING AND DECODING APPARATUSES AND METHODS

CROSS-REFERENCE TO RELATED APPLICATIONS

This application claims priority from Korean Patent Application No. 10-2005-0106354, filed on Nov. 8, 2005, in the Korean Intellectual Property Office, the disclosure of which is incorporated herein in its entirety by reference.

BACKGROUND OF THE INVENTION

1. Field of the Invention

The present general inventive concept relates to audio encoding and decoding apparatuses and methods, and more particularly, to adaptive time/frequency-based audio encoding and decoding apparatuses and methods which can obtain high compression efficiency by making efficient use of encoding gains of two encoding methods in which a frequency-domain transform is performed on input audio data such that time-based encoding is performed on a band of the audio data suitable for voice compression and frequency-based encoding is performed on remaining bands of the audio data.

2. Description of the Related Art

Conventional voice/music compression algorithms can be broadly classified into audio codec algorithms and voice codec algorithms. Audio codec algorithms, such as aacPlus, compress a frequency-domain signal and apply a psychoacoustic model. Assuming that the audio codec and the voice codec compress voice signals have an equal amount of data, the audio codec algorithm outputs sound having a significantly lower quality than the voice codec algorithm. In particular, the quality of sound output from the audio codec algorithm is more adversely affected by an attack signal.

Voice codec algorithms, such as an adaptive multi-rate wideband codec (AMR-WB), compress a time-domain signal and apply a voicing model. Assuming that the voice codec and the audio codec compress audio signals having an equal amount of data, the voice codec algorithm outputs sound having a significantly lower quality than the audio codec algorithm.

An AMR-WB plus algorithm considers the above characteristics of the conventional voice/music compression algorithm to efficiently perform voice/music compression. In the AMR-WB plus algorithm, an algebraic code excited linear prediction (ACELP) algorithm is used as a voice compression algorithm and a Tex character translation (TCX) algorithm is used as an audio compression algorithm. In particular, the AMR-WB plus algorithm determines whether to apply the ACELP algorithm or the TCX algorithm to each processing unit, for example, each frame on a time axis, and then performs encoding accordingly. In this case, the AMR-WB plus algorithm is effective in compressing what is close to a voice signal. However, when the AMR-WB plus algorithm is used to compress what is close to an audio signal, the sound quality or compression rate deteriorates since the AMR-WB plus algorithm performs encoding in processing units.

SUMMARY OF THE INVENTION

The present general inventive concept provides adaptive time/frequency-based audio encoding and decoding apparatuses and methods which can obtain high compression efficiency by making efficient use of encoding gains of two encoding methods in which a frequency-domain transform is performed on input audio data such that time-based encoding is performed on a band of the audio data suitable for voice compression and frequency-based encoding is performed on remaining bands of the audio data.

Additional aspects of the present general inventive concept will be set forth in part in the description which follows and, in part, will be obvious from the description, or may be learned by practice of the general inventive concept.

The foregoing and/or other aspects and utilities of the present general inventive concept are achieved by providing an adaptive time/frequency-based audio encoding apparatus including a transformation & mode determination unit to divide an input audio signal into a plurality of frequency-domain signals and to select a time-based encoding mode or a frequency-based encoding mode for each respective frequency-domain signal, an encoding unit to encode each frequency-domain signal in the respective encoding modes selected by the transformation & mode determination unit, and a bitstream output unit to output encoded data, division information, and encoding mode information for each respective encoded frequency-domain signal.

The transformation & mode determination unit may include a frequency-domain transform unit to transform the input audio signal into a full frequency-domain signal, and an encoding mode determination unit to divide the full frequency-domain signal into the frequency-domain signals according to a preset standard and to determine the time-based encoding mode or the frequency-based encoding mode for each respective frequency-domain signal.

The full frequency-domain signal may be divided into the frequency-domain signals suitable for the time-based encoding mode or the frequency-based encoding mode based on at least one of a spectral tilt, a size of signal energy of each frequency domain, a change in signal energy between subframes and a voicing level determination, and the respective encoding mode for each frequency-domain signal is determined accordingly.

The encoding unit may include a time-based encoding unit to perform an inverse frequency-domain transform on a first frequency-domain signal determined to be encoded in the time-based encoding mode and to perform time-based encoding on the first frequency-domain signal on which the inverse frequency-domain transform has been performed, and a frequency-based encoding unit to perform frequency-based encoding on a second frequency-domain signal determined to be encoded in the frequency-based encoding mode.

The time-based encoding unit may select the encoding mode for the first frequency-domain signal based on at least one of a linear coding gain, a spectral change between linear prediction filters of adjacent frames, a predicted pitch delay, and a predicted long-term prediction gain, continue to perform the time-based encoding on the first frequency-domain signal when the time-based encoding unit determines that the time-based encoding mode is suitable for the first frequency-domain signal, and stop performing the time-based encoding on the first frequency-domain signal and transmit a mode conversion control signal to the transformation & mode determination unit when the time-based encoding unit determines that the frequency-based encoding mode is suitable for the first frequency-domain signal, and the transformation & mode determination unit may output the first frequency-domain signal, which was provided to the time-based encoding unit, to the frequency-based encoding unit in response to the mode conversion control signal.

The frequency-domain transform unit may perform the frequency-domain transform using a frequency varying modulated lapped transform (MLT). The time-based encoding unit may quantize a residual signal obtained from linear prediction and dynamically allocate bits to the quantized residual signal according to importance. The time-based encoding unit may transform the residual signal obtained from the linear prediction into a frequency-domain signal, quantize the frequency-domain signal, and dynamically allocate the bits to the quantized signal according to importance. The importance may be determined based on a voicing model.

The frequency-based encoding unit may determine a quantization step size of an input frequency-domain signal according to a psychoacoustic model and quantize the frequency-domain signal. The frequency-based encoding unit may extract important frequency components from an input frequency-domain signal according to the psychoacoustic model, encode the extracted important frequency components, and encode the remaining signals using noise modeling.

The residual signal may be obtained using a code excited linear prediction (CELP) algorithm.

The foregoing and/or other aspects and utilities of the present general inventive concept are also achieved by providing an audio data encoding apparatus, including a transformation and mode determination unit to divide a frame of audio data into first audio data and second audio data, and an encoding unit to encode the first audio data in a time domain and to encode the second audio data in a frequency domain.

The foregoing and/or other aspects and utilities of the present general inventive concept are also achieved by providing an adaptive time/frequency-based audio decoding apparatus including a bitstream sorting unit to extract encoded data for each frequency band, division information, and encoding mode information for each frequency band from an input bitstream, a decoding unit to decode the encoded data for each frequency domain based on the division information and the respective encoding mode information, and a collection & inverse transform unit to collect decoded data in a frequency domain and to perform an inverse frequency-domain transform on the collected data.

The decoding unit may include a time-based decoding unit to perform time-based decoding on first encoded data based on the division information and respective first encoding mode information, and a frequency-based decoding unit to perform frequency-based decoding on second encoded data based on the division information and respective second encoding mode information.

The collection & inverse transform unit may perform envelope smoothing on the decoded data in the frequency domain and then perform the inverse frequency-domain transform on the decoded data such that the decoded data maintains continuity in the frequency domain.

The foregoing and/or other aspects and utilities of the present general inventive concept are also achieved by providing an audio data decoding apparatus, including a bitstream sorting unit to extract encoded audio data of a frame, and a decoding unit to decode the audio data of the frame into first audio data in a time domain and second audio data in a frequency domain.

The foregoing and/or other aspects and utilities of the present general inventive concept are also achieved by providing an adaptive time/frequency-based audio encoding method including dividing an input audio signal into a plurality of frequency-domain signals and selecting a time-based encoding mode or a frequency-based encoding mode for each respective frequency-domain signal, encoding each frequency-domain signal in the respective encoding mode, and outputting encoded data, division information, and encoding mode information of each respective frequency-domain signal.

The foregoing and/or other aspects and utilities of the present general inventive concept are also achieved by providing an audio data encoding method, including dividing a frame of audio data into first audio data and second audio data, and encoding the first audio data in a time domain and encoding the second audio data in a frequency domain.

The foregoing and/or other aspects and utilities of the present general inventive concept are also achieved by providing an adaptive time/frequency-based audio decoding method including extracting encoded data for each frequency band from an input bitstream, division information, and encoding mode information for each respective frequency band, decoding the encoded data for each frequency domain based on the division information and the respective encoding mode information, and collecting decoded data in a frequency domain and performing an inverse frequency-domain transform on the collected data.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

The present general inventive concept will now be described more fully with reference to the accompanying drawings, in which exemplary embodiments of the general inventive concept are illustrated. The general inventive concept may, however, be embodied in many different forms and should not be construed as being limited to the embodiments set forth herein, rather, these embodiments are provided so that this description will be thorough and complete, and will fully convey the aspects and utilities of the general inventive concept to those skilled in the art.

The present general inventive concept selects a time-based encoding method or a frequency-based encoding method for each frequency band of an input audio signal and encodes each frequency band of the input audio signal using the selected encoding method. When a prediction gain obtained from linear prediction is great or when the input audio signal is a high pitched signal, such as a voice signal, the time-based encoding method is more effective. When the input audio signal is a sinusoidal signal, when a high-frequency signal is included in the input audio signal, or when a masking effect between signals is great, the frequency-based encoding method is more effective.

In the present general inventive concept, the time-based encoding method denotes a voice compression algorithm, such as a code excited linear prediction (CELP) algorithm, which performs compression on a time axis. In addition, the frequency-based encoding method denotes an audio compression algorithm, such as a Tex character translation (TCX) algorithm and an advanced audio coding (AAC) algorithm, which performs compression on a frequency axis.

Additionally, the embodiments of the present general inventive concept divide a frame of audio data, which is typically used as a unit for processing (e.g., encoding, decoding, compressing, decompressing, filtering, compensating, etc.) audio data, into sub-frames, bands, or frequency domain signals within the frame such that first audio data of the frame that can be effectively encoded as voice audio data in the time domain while second audio data of the frame that can be effectively encoded as non-voice audio data in the frequency domain.

Figure 1:
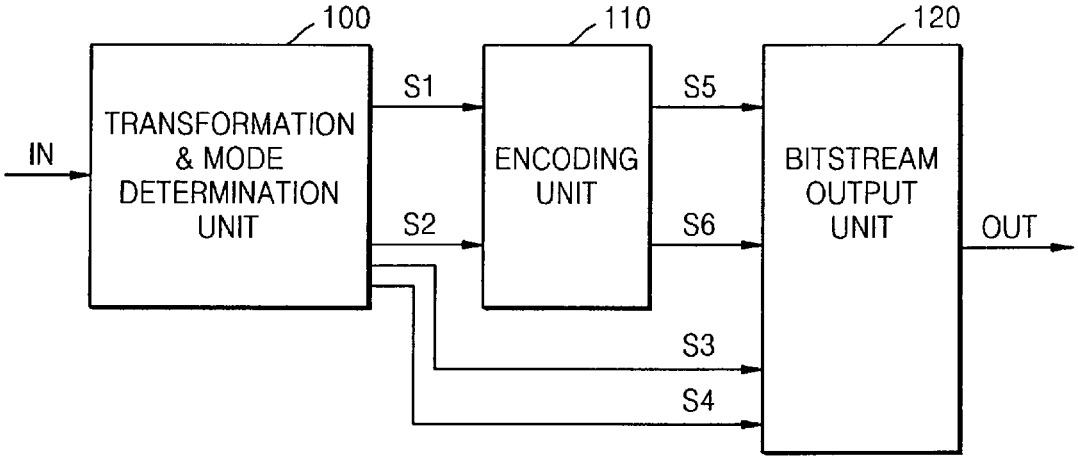
FIG. 1 is a block diagram illustrating an adaptive time/frequency-based audio encoding apparatus according to an embodiment of the present general inventive concept.

FIG. 1 is a block diagram illustrating an adaptive time/frequency-based audio encoding apparatus according to an embodiment of the present general inventive concept. The apparatus includes a transformation & mode determination unit 100, an encoding unit 110, and a bitstream output unit 120.

The transformation & mode determination unit 100 divides an input audio signal IN into a plurality of frequency-domain signals and selects a time-based encoding mode or a frequency-based encoding mode for each frequency-domain signal. Then, the transformation & mode determination unit 100 outputs a frequency-domain signal S1 determined to be encoded in the time-based encoding mode, a frequency-domain signal S2 determined to be encoded in the frequency-based encoding mode, and division information S3 and encoding mode information S4 for each frequency-domain signal. When the input audio signal IN is consistently divided, a decoding end may not require the division information S3. In this case, the division information S3 may not need to be output through the bitstream output unit 120.

The encoding unit 110 performs time-based encoding on the frequency-domain signal S1 and performs frequency-based encoding on the frequency-domain signal S2. The encoding unit 110 outputs data S5 on which the time-based encoding has been performed and data S6 on which the frequency-based encoding has been performed.

The bitstream output unit 120 collects the data S5 and S6, the division information S3 and the encoding mode information S4 of each frequency-domain signal, and outputs a bitstream OUT. Here, the bitstream OUT may have a data compression process performed thereon, such as an entropy-encoding process.

Figure 2:
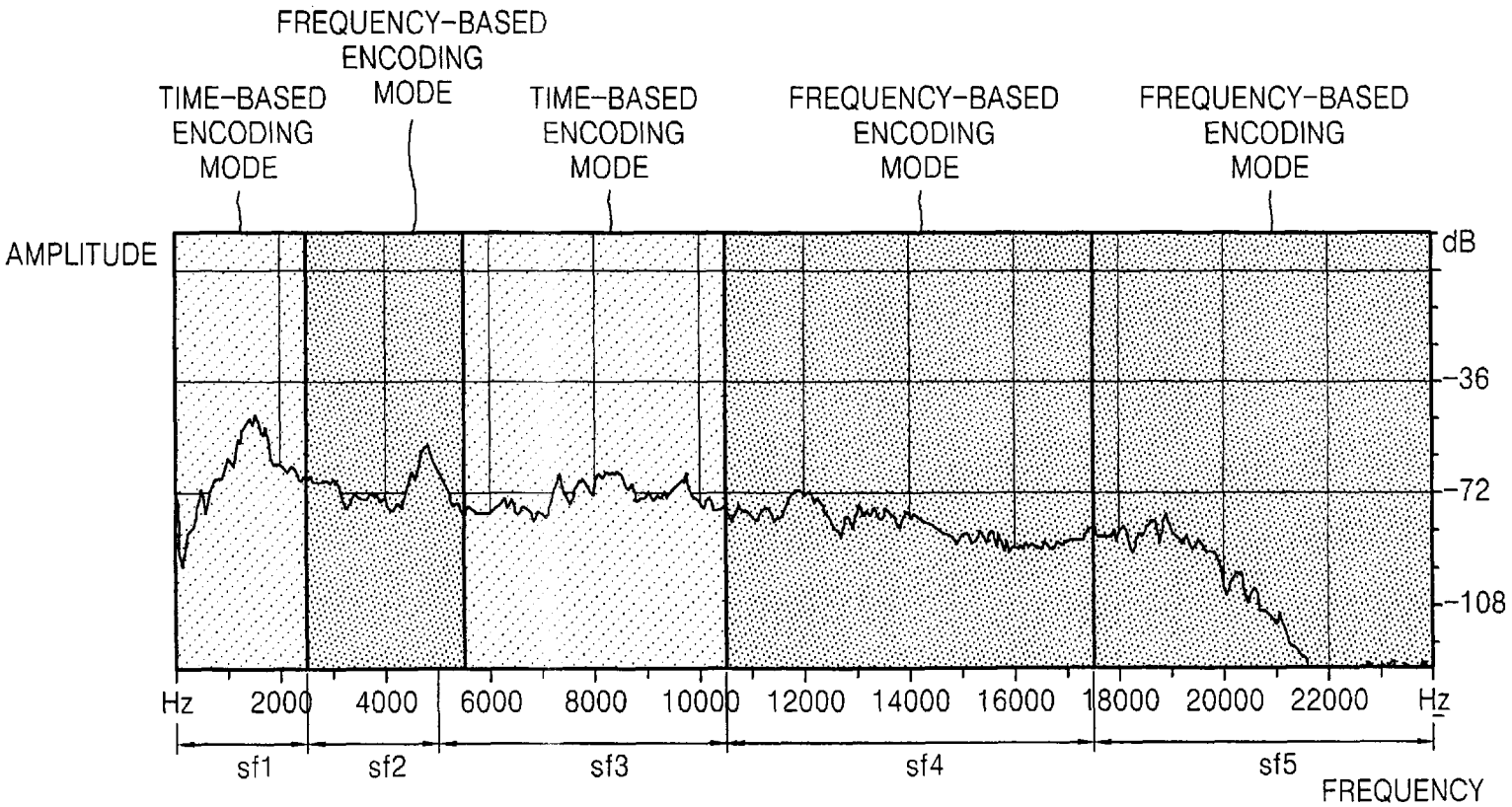
FIG. 2 is a conceptual diagram illustrating a method of dividing a signal on which a frequency-domain transform has been performed and determining an encoding mode using a transformation & mode determination unit of the adaptive time/frequency-based audio encoding apparatus of FIG. 1, according to an embodiment of the present general inventive concept.

FIG. 2 is a conceptual diagram illustrating a method of dividing a signal on which a frequency-domain transform has been performed, and determining an encoding mode using the transformation & mode determination unit 100 of FIG. 1, according to an embodiment of the present general inventive concept.

Referring to FIG. 2, an input audio signal (e.g., the input audio signal IN) includes a frequency component of 22,000 Hz and is divided into five frequency bands (e.g., corresponding to five frequency domain signals). The time-based encoding mode, the frequency-based encoding mode, the time-based encoding mode, the frequency-based encoding mode, and the frequency-based encoding mode are respectively determined for the five frequency bands in the order of lowest to highest frequency band. The input audio signal is an audio frame for a predetermined period of time, for example, 20 ms. In other words, FIG. 2 is a graph illustrating the audio frame on which the frequency-domain transform has been performed. The audio frame is divided into five sub-frames sf1, sf2, sf3, sf4 and sf5 corresponding to five frequency domains (i.e., bands), respectively.

In order to divide the input audio signal into the five frequency bands and determine the corresponding encoding mode for each band as illustrated in FIG. 2, a spectral measuring method, an energy measuring method, a long-term prediction estimation method, and a voicing level determination method that distinguishes a voice sound from a voiceless sound may be used. Examples of the spectral measuring method include dividing and determining based on a linear prediction coding gain, a spectral change between linear prediction filters of adjacent frames, and a spectral tilt. Examples of the energy measuring method include dividing and determining based on the size of signal energy of each band and a change in signal energy between bands. In addition, examples of the long-term prediction estimation method include dividing and determining based on a predicted pitch delay and a predicted long-term prediction gain.

Figure 3:
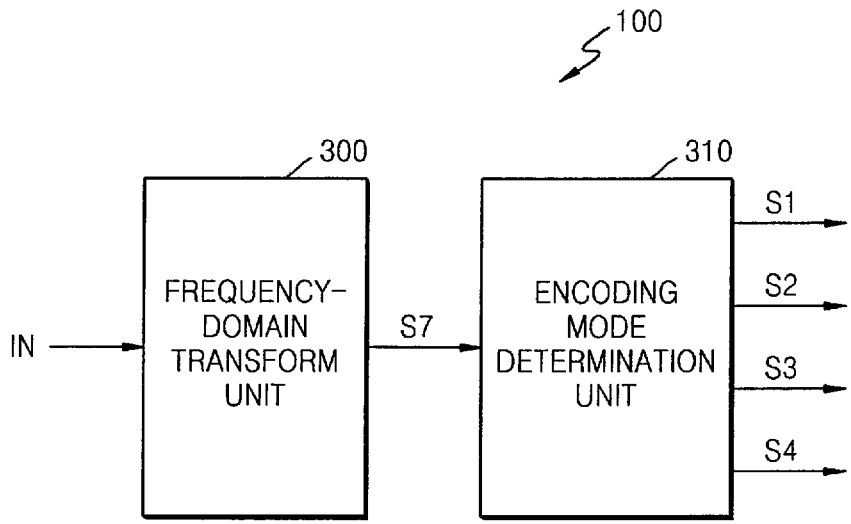
FIG. 3 is a detailed block diagram illustrating the transformation & mode determination unit of the adaptive time/frequency-based audio encoding apparatus of FIG. 1.

FIG. 3 is a detailed block diagram illustrating an exemplary embodiment of the transformation & mode determination unit 100 of FIG. 1. The transformation & mode determination unit 100, as illustrated in FIG. 3, includes a frequency-domain transform unit 300 and an encoding mode determination unit 310.

The frequency-domain transform unit 300 transforms the input audio signal IN into a full frequency-domain signal S7 having a frequency spectrum as illustrated in FIG. 2. The frequency-domain transform unit 300 may use a modulated lapped transform (MLT) as a frequency-domain transform method.

The encoding mode determination unit 310 divides the full frequency-domain signal S7 into the plurality of frequency-domain signals according to a preset standard and selects either the time-based encoding mode or the frequency-based encoding mode for each frequency-domain signal based on the preset standard and/or a linear prediction coding gain, a spectral change between linear prediction filters of adjacent frames, a spectral tilt, the size of signal energy of each band, a change in signal energy between bands, a predicted pitch delay, or a predicted long-term prediction gain. That is, the encoding mode can be selected for each of the frequency-domain signal based on approximations, predictions, and/or estimations of frequency characteristics thereof. These approximations, predictions, and/or estimations of the frequency characteristics can estimate which ones of the frequency domain-signals should be encoded using the time-based encoding mode such that remaining ones of the frequency domain-signals can be encoded in the frequency-based encoding mode. As described below, the selected encoding mode (e.g., the time based encoding mode) can subsequently be confirmed based on data generated during the encoding process such that the encoding process can be efficiently performed.

Then, the encoding mode determination unit 310 outputs the frequency-domain signal S1 determined to be encoded in the time-based encoding mode, the frequency-domain signal S2 determined to be encoded in the frequency-based encoding mode, the division information S3, and the encoding mode information S4 for each frequency-domain signal. The preset standard may be what can be determined in a frequency domain among the criteria for selecting the encoding mode described above. That is, the preset standard may be the spectral tilt, the size of signal energy of each frequency domain, the change in signal energy between sub-frames, or the voicing level determination. However, the present general inventive concept is not limited thereto.

Figure 4:
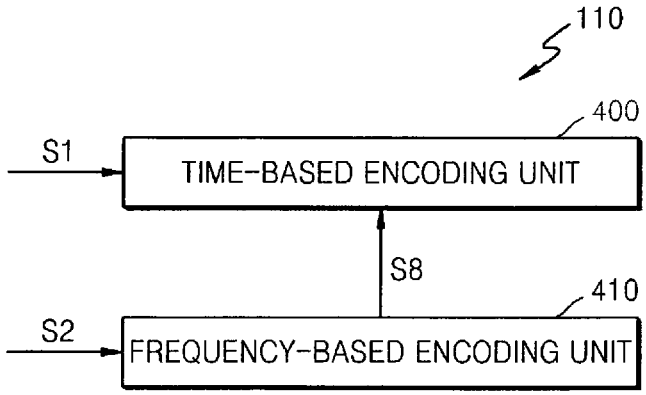
FIG. 4 is a detailed block diagram illustrating an encoding unit of the adaptive time/frequency-based audio encoding apparatus of FIG. 1.

FIG. 4 is a detailed block diagram illustrating an exemplary embodiment of the encoding unit 110 of FIG. 1. The encoding unit 110 as illustrated in FIG. 4 includes a time-based encoding unit 400 and a frequency-based encoding unit 410.

The time-based encoding unit 400 performs time-based encoding on the frequency-domain signal S1 using, for example, a linear prediction method. Here, an inverse frequency-domain transform is performed on the frequency-domain signal S1 before the time-based encoding such that the time-based encoding is performed once the frequency domain signal S1 is converted to the time domain.

The frequency-based encoding unit 410 performs the frequency-based encoding on the frequency-domain signal S2.

Since the time-based encoding unit 400 uses an encoding component of a previous frame, the time-based encoding unit 400 includes a buffer (not illustrated) that stores the encoding component of the previous frame. The time-based encoding unit 400 receives an encoding component S8 of a current frame from the frequency-based encoding unit 410, stores the encoding component S8 of the current frame in the buffer, and uses the stored encoding component S8 of the current frame to encode a next frame. This process will now be described in detail with reference to FIG. 2.

In particular, if the third sub-frame sf3 of the current frame is to be encoded by the time-based encoding unit 400 and frequency-based encoding has been performed on the third sub-frame sf3 of the previous frame, a linear predictive coding (LPC) coefficient of the third sub-frame sf3 of the previous frame is used to perform the time-based encoding on the third sub-frame sf3 of the current frame. The LPC coefficient is the encoding component S8 of the current frame, which is provided to the time-based encoding unit 400 and stored therein.

Figure 5:
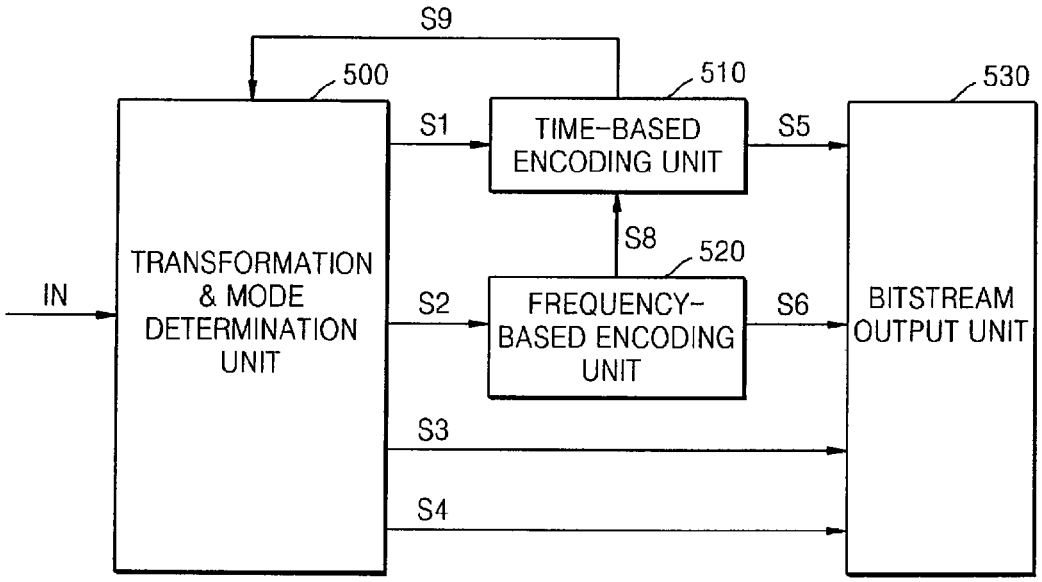
FIG. 5 is a block diagram of an adaptive time/frequency-based audio encoding apparatus having a time-based encoding unit of FIG. 4 with a function to confirm a determined encoding mode, according to another embodiment of the present general inventive concept.

FIG. 5 is a block diagram illustrating an adaptive time/frequency-based audio encoding apparatus including a time-based encoding unit 510 (similar to the time-based encoding unit 400 of FIG. 4) with a function used to confirm a determined encoding mode, according to another embodiment of the present general inventive concept. The apparatus includes a transformation & mode determination unit 500, the time-based encoding unit 510, a frequency-based encoding unit 520, and a bitstream output unit 530.

The frequency-based encoding unit 520 and the bitstream output unit 530 operate and function as described above.

The time-based encoding unit 510 performs the time-based encoding, as described above. In addition, the time-based encoding unit 510 determines whether the time-based encoding mode is suitable for the received frequency-domain signal S1 based on intermediate data values obtained during the time-based encoding. In other words, the time-based encoding unit 510 confirms the encoding mode determined by the transformation & mode determination unit 500 for the received frequency-domain signal S1. That is, the time-based encoding unit 510 confirms that the time-based encoding is appropriate for the received frequency domain signal S1 during the time based encoding, based on the intermediate data values.

If the time-based encoding unit 510 determines that the frequency-based encoding mode is suitable for the frequency-domain signal S1, the time-based encoding unit 510 stops performing time-based encoding on the frequency-domain signal S1 and provides a mode conversion control signal S9 back to the transformation & mode determination unit 500. If the time-based encoding unit 510 determines that the time-based encoding mode is suitable for the frequency-domain signal S1, the time-based encoding unit 510 continues to perform the time-based encoding on the frequency-domain signal S1. The time-based encoding unit 510 determines whether the time-based encoding mode or the frequency-based encoding mode is suitable for the frequency-domain signal S1 based on at least one of a linear coding gain, a spectral change between linear prediction filters of adjacent frames, a predicted pitch delay, and a predicted long-term prediction gain, all of which are obtained from the encoding process.

When the mode conversion control signal S9 is generated, the transformation & mode determination unit 500 converts a current encoding mode of the frequency-domain signal S1 in response to the mode conversion control signal S9. As a result, the frequency-based encoding is performed on the frequency-domain signal S1 which was initially determined to be encoded in the time-based encoding mode. Accordingly, the encoding mode information S4 is changed from the time-based encoding mode to the frequency-based encoding mode. Then, the changed encoding mode information S4, that is, information indicating the frequency-based encoding mode, is transmitted to the decoding end.

Figure 6:
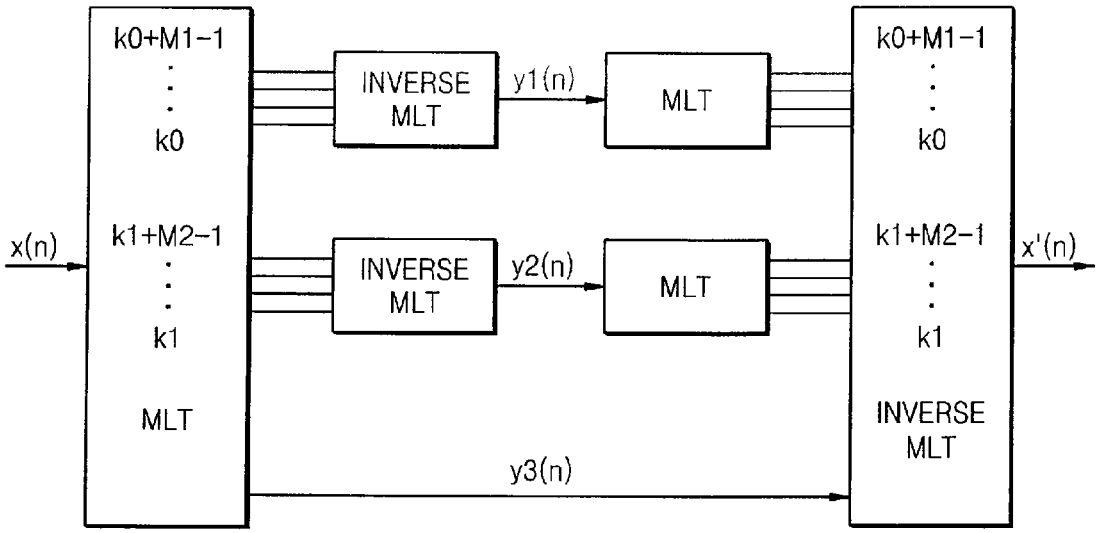
FIG. 6 is a conceptual diagram illustrating a frequency-varying modulated lapped transform (MLT), which is an example of a frequency-domain transform method according to an embodiment of the present general inventive concept.

FIG. 6 is a conceptual diagram illustrating a frequency-varying MLT (modulated lapped transform), which is an example of the frequency-domain transform method according to an embodiment of the present general inventive concept.

As described above, the frequency-domain transform method according to the present general inventive concept uses the MLT. Specifically, the frequency-domain transform method applies the frequency-varying MLT in which the MLT is performed on a portion of the entire frequency band. The frequency-varying MLT is described in detail in "A New Orthonormal Wavelet Packet Decomposition for Audio Coding Using Frequency-Varying Modulated Lapped Transform" by M. Purat and P. Noll, IEEE Workshop on Application of Signal Processing to Audio and Acoustics, October 1995, which is incorporated herein in its entirety.

Referring to FIG. 6, an input signal x(n) is MLTed and then represented as N frequency components. Of the N frequency components, M1 frequency components and M2 frequency components are inverse MLTed and then represented as time-domain signals y1(*n*) and y2(*n*), respectively. The remaining frequency components are represented as a signal y3(*n*). Time-based encoding is performed on the time-domain signals y1 (*n*) and y2(*n*), and frequency-based encoding is performed on the signal y3(*n*). Conversely, at the decoding end, time-based decoding and then the MLT are performed on the time-domain signals y1 (*n*) and y2(*n*), and frequency-based decoding is performed on the signal y3(*n*). The MLTed signals y1(*n*), y2(*n*) and the signal y3(*n*) on which the frequency-based decoding was performed are inverse MLTed. Consequently, the input signal x(n) is restored to a signal x'(n). In FIG. 6, the encoding and decoding processes are not illustrated, and only the transform process is illustrated. The encoding and decoding processes are performed in stages indicated by the signals y1(*n*), y2(*n*), and y3(*n*). The signals y1(*n*), y2(*n*), and y3(*n*) have resolutions of frequency bands M1, M2, and N-M1-M2.

Figure 7A:
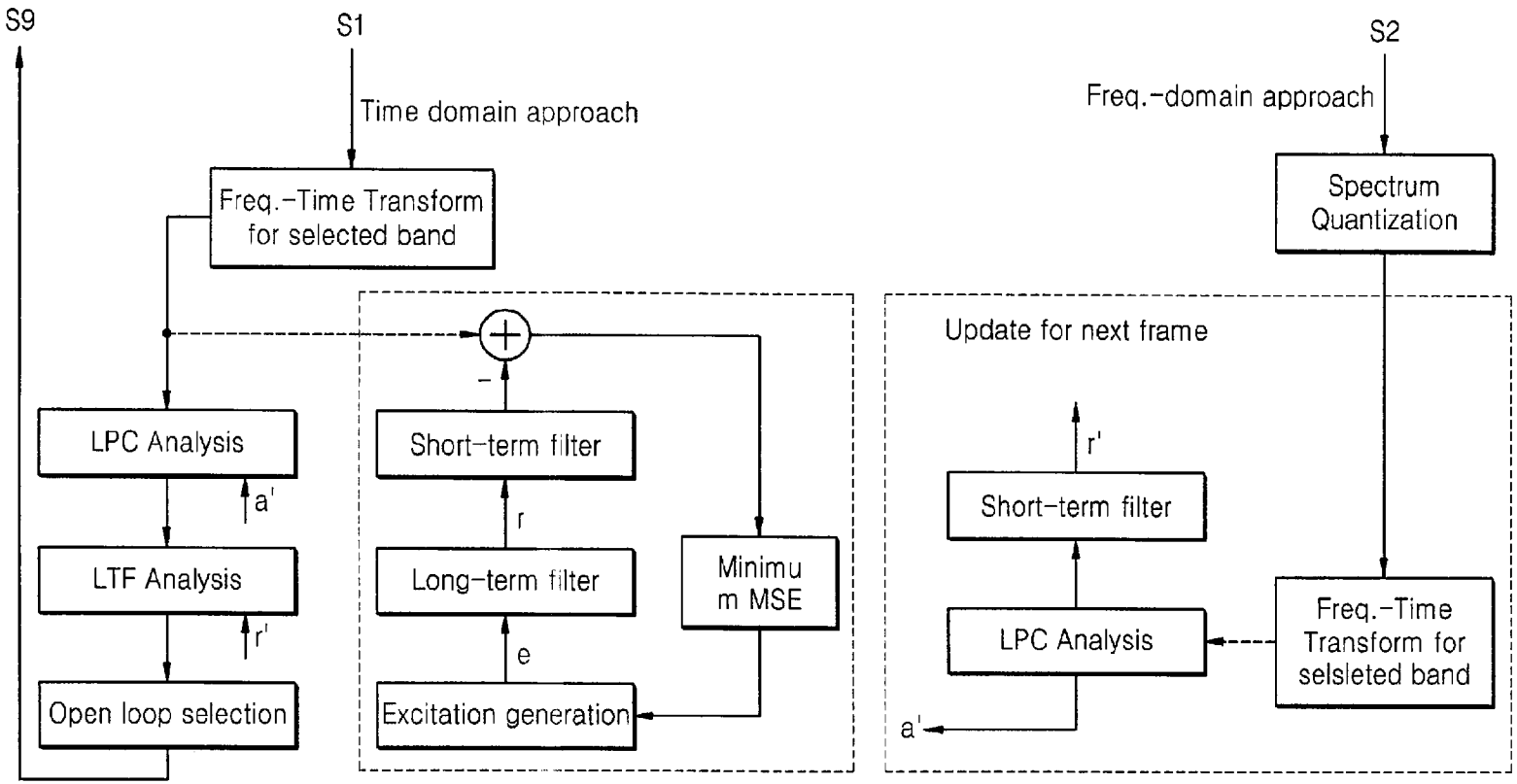
FIG. 7A is a conceptual diagram illustrating detailed operations of the time-based encoding unit and a frequency-based encoding unit of the adaptive time/frequency-based audio encoding apparatus of FIG. 5, according to an embodiment of the present general inventive concept.

FIG. 7A is a conceptual diagram illustrating detailed operations of the time-based encoding unit 510 and the frequency-based encoding unit 520 of FIG. 5, according to an embodiment of the present general inventive concept. FIG. 7A illustrates a case in which a residual signal (r') of the time-based encoding unit 510 is quantized in the time domain.

Referring to FIG. 7A, an inverse frequency-based transform is performed on the frequency-domain signal S1 output from the transformation & mode determination unit 500. A linear prediction coefficient (LPC) analysis is performed on the frequency domain signal S1, which has been transformed to the time domain, using a restored LPC coefficient (a') received from an operation of the frequency based encoding unit 410 (as described above). After the linear prediction coefficient (LPC) analysis and the LTF analysis, an open loop selection is made. In other words, it is determined whether the time-based encoding mode is suitable for the frequency-domain signal S1. The open loop selection is made based on at least one of a linear coding gain, a spectral change between linear prediction filters of adjacent frames, a predicted pitch delay, and a predicted long-term prediction gain, all of which are obtained from the time-based encoding process.

The open loop selection is made in the time-based encoding process. If it is determined that the time-based encoding mode is suitable for the frequency-domain signal S1, the time-based encoding continues to be performed on the frequency-domain signal S1. As a result, data on which the time-based encoding was performed is output, including a long-term filter coefficient, a short-term filter coefficient, and an excitation signal "e." If it is determined that the frequency-based encoding mode is suitable for the frequency-domain signal S1, the mode conversion control signal S9 is transmitted to the transformation & mode determination unit 500. In response to the mode conversion control signal S9, the transformation & mode determination unit 500 determines the frequency-domain signal S1 to be encoded in the frequency-based encoding mode and outputs the frequency-domain signal S2 determined to be encoded in the frequency-based encoding mode. Then, frequency-domain encoding is performed on the frequency-domain signal S2. In other words, the transformation & mode determination unit 500 outputs the frequency-domain signal S1 again as S2 to the frequency-based encoding unit 410 such that the frequency domain signal can be encoded in the frequency based encoding mode (instead of the time based encoding mode).

The frequency-domain signal S2 output from the transformation & mode determination unit 500 is quantized in the frequency domain, and quantized data is output as data on which frequency-based encoding was performed.

Figure 7B:
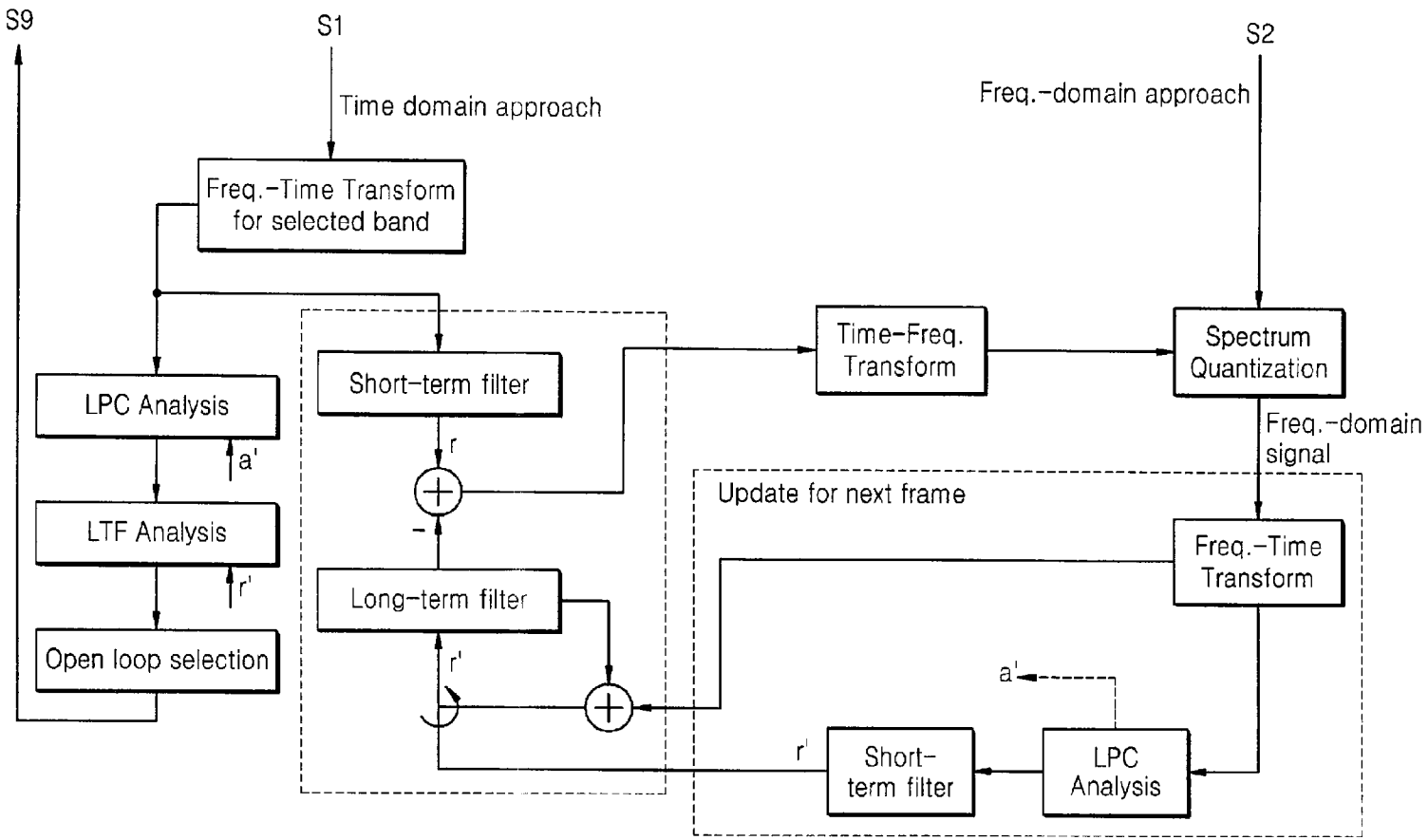
FIG. 7B is a conceptual diagram illustrating detailed operations of the time-based encoding unit and the frequency-based encoding unit of the adaptive time/frequency-based audio encoding apparatus of FIG. 5, according to another embodiment of the present general inventive concept.

FIG. 7B is a conceptual diagram illustrating detailed operations of the time-based encoding unit 510 and the frequency-based encoding unit 520 of FIG. 5, according to another embodiment of the present general inventive concept. FIG. 7B illustrates a case in which a residual signal of the time-based encoding unit 510 is quantized in the frequency domain.

Referring to FIG. 7B, the open loop selection and the time-based encoding are performed on the frequency-domain signal S1 output from the transformation & mode determination unit 500, as described with reference to FIG. 7A. However, in the time-based encoding of the present embodiment, the residual signal is frequency-domain-transformed and then quantized in the frequency domain.

In order to perform the time-based encoding on the current frame, the restored LPC coefficient (a') of the previous frame and the residual signal (r') are used. In this case, a process of restoring the LPC coefficient a' is identical to the process illustrated in FIG. 7A. However, a process of restoring the residual signal (r') is different. When the frequency-based encoding is performed on a corresponding frequency domain of the previous frame, data quantized in the frequency domain is inverse frequency-domain-transformed and added to an output of a long-term filter. As a result, the residual signal r' is restored. When the time-based encoding is performed on the frequency domain of the previous frame, the data quantized in the frequency domain go through the inverse frequency-domain transform, the LPC analysis, and the short-term filter.

Figure 8:
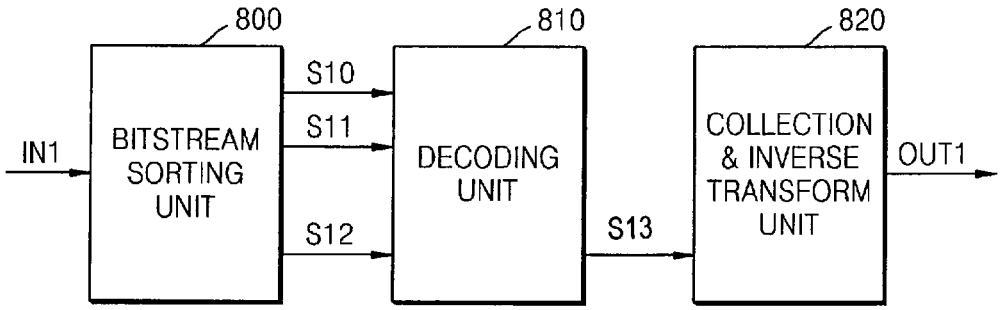
FIG. 8 is a block diagram of an adaptive time/frequency-based audio decoding apparatus according to an embodiment of the present general inventive concept.

FIG. 8 is a block diagram illustrating an adaptive time/frequency-based audio decoding apparatus, according to an embodiment of the present general inventive concept. Referring to FIG. 8, the apparatus includes a bitstream sorting unit 800, a decoding unit 810, and a collection & inverse transform unit 820.

For each frequency band (i.e., domain) of an input bitstream IN1, the bitstream sorting unit 800 extracts encoded data S10, division information S11, and encoding mode information S12.

The decoding unit 810 decodes the encoded data S10 for each frequency band based on the extracted division information S11 and the encoding mode information S12. The decoding unit 810 includes a time-based decoding unit (not shown), which performs time-based decoding on the encoded data S10 based on the division information S11 and the encoding mode information S12, and a frequency-based decoding unit (not shown).

The collection & inverse transform unit 820 collects decoded data S13 in the frequency domain, performs an inverse frequency-domain transform on the collected data S13, and outputs audio data OUT1. In particular, data on which time-based decoding is performed is inverse frequency-domain-transformed, before being collected in the frequency domain. When the decoded data S13 for each frequency band is collected in the frequency domain, similar to a frequency spectrum of FIG. 2, an envelope mismatch between two adjacent frequency bands (i.e., sub-frames) may occur. In order to prevent the envelope mismatch in the frequency domain, the collection & inverse transform unit 820 performs envelope smoothing on the decoded data S13, before collecting the same.

Figure 9:
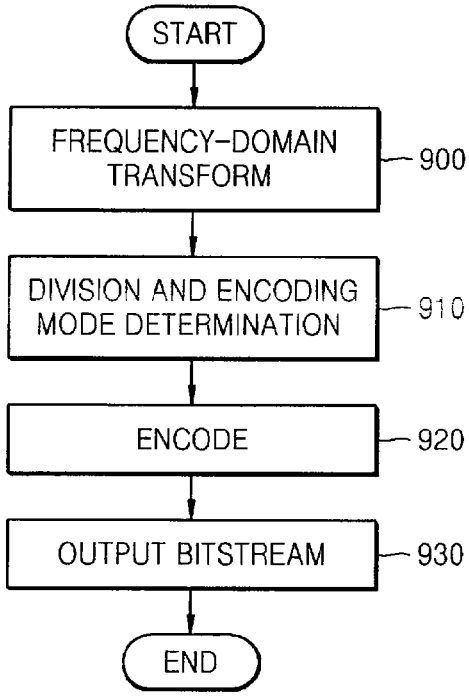
FIG. 9 is a flowchart illustrating an adaptive time/frequency-based audio encoding method according to an embodiment of the present general inventive concept.

FIG. 9 is a flowchart illustrating an adaptive time/frequency-based audio encoding method, according to an embodiment of the present general inventive concept. The method of FIG. 9 may be performed by the adaptive time/frequency-based audio encoding apparatuses of FIG. 1 and/or FIG. 5. Accordingly, for illustration purposes, the method of FIG. 9 is described below with reference to FIGS. 1 to 7B. Referring to FIGS. 1 to 7B, and 9, the input audio signal IN is transformed by the frequency-domain transform unit 300 into a full frequency-domain signal (operation 900).

The full frequency-domain signal is divided into the plurality of frequency-domain signals (corresponding to the bands) by the encoding mode determination unit 310 according to the preset standard, and the encoding mode suitable for each respective frequency-domain signal is determined (operation 910). As described above, the full frequency-domain signal is divided into the frequency-domain signals suitable for the time-based encoding mode or the frequency-based encoding mode based on at least one of the spectral tilt, the size of signal energy of each frequency domain, the change in signal energy between the sub-frames, and the voicing level determination. Then, the encoding mode suitable for each respective frequency-domain signal is determined according to the preset standard and the division of the full-frequency domain signal.

Each frequency-domain signal is encoded by the encoding unit 110 in the determined encoding mode (operation 920). In other words, the time-based encoding unit 400 (and 510) performs the time-based encoding on the frequency-domain signal S1 determined to be encoded in the time-based encoding mode, and the frequency-based encoding unit 410 (and 520) performs the frequency-based encoding on the frequency-domain signal S2 determined to be encoded in the frequency-based encoding mode. The frequency domain signal S2 may be a different frequency band from the band of the frequency domain signal S1, or the bands may be the same when the time based encoding unit 400 (and 51) determines that the time based encoding is not suitable for encoding the frequency domain signal S1.

The time-based encoded data S5, the frequency-based encoded data S6, the division information S3, and the determined encoding mode information S4 are collected by the bitstream output unit 120 and output as the bitstream OUT (operation 930).

Figure 10:
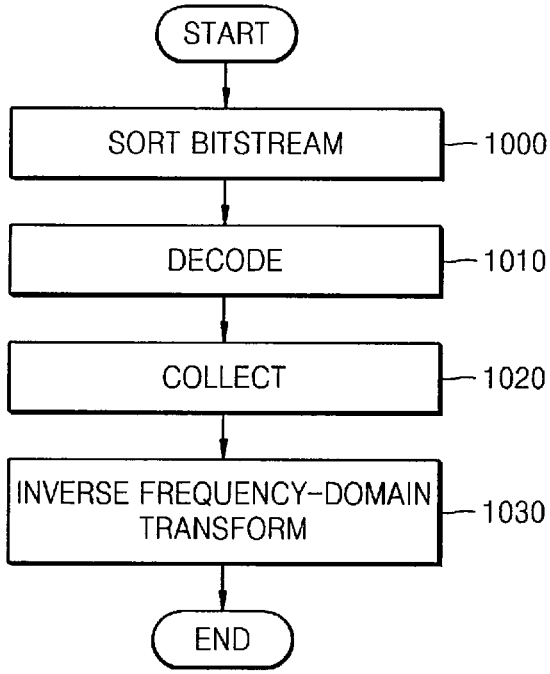
FIG. 10 is a flowchart illustrating an adaptive time/frequency-based audio decoding method according to an embodiment of the present general inventive concept.

FIG. 10 is a flowchart illustrating an adaptive time/frequency-based audio decoding method, according to an embodiment of the present general inventive concept. The method of FIG. 10 may be performed by the adaptive time/frequency-based audio decoding apparatus of FIG. 8. Accordingly, for illustration purposes, the method of FIG. 10 is described below with reference to FIG. 8. Referring to FIG. 10, the encoded data S10 for each frequency band (i.e., domain), the division information S11, and the encoding mode information S12 of each respective frequency band are extracted by the bitstream sorting unit 800 from the input bitstream IN1 (operation 1000).

The encoded data S10 is decoded by the decoding unit 810 based on the extracted division information S11 and the encoding mode information S12 (operation 1010).

The decoded data S13 is collected in the frequency domain by the collection & inverse transform unit 820 (operation 1020). The envelope smoothing may be additionally performed on the collected data S13 to prevent the envelope mismatch in the frequency domain.

The inverse frequency-domain transform is performed on the collected data S13 by the collection & inverse transform unit 820 and is output as the audio data OUT1, which is a time-based signal (operation 1030).

According to the embodiments of the present general inventive concept, acoustic characteristics and a voicing model are simultaneously applied to a frame which is an audio compression processing unit. As a result, a compression method effective for both music and voice can be produced, and the compression method can be used for mobile terminals that require audio compression at a low bit rate.

The present general inventive concept can also be embodied as computer-readable code on a computer-readable recording medium. The computer-readable recording medium may be any data storage device that can store data which can be thereafter read by a computer system. Examples of the computer-readable recording medium include read-only memory (ROM), random-access memory (RAM), CD-ROMs, magnetic tapes, floppy disks, and optical data storage devices.

The computer-readable recording medium can also be distributed over network-coupled computer systems so that the computer-readable code is stored and executed in a distributed fashion. Also, functional programs, code, and code segments for accomplishing the present general inventive concept can be easily construed by programmers skilled in the art to which the present general inventive concept pertains.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An adaptive time/frequency-based audio encoding apparatus, comprising:

a transformation & mode determination unit to divide an input audio signal into a plurality of frequency-domain signals and to select a time-based encoding mode or a frequency-based encoding mode for each respective frequency-domain signal;

a time-based encoding unit, implemented by at least one processing device, to perform time-based encoding in a linear prediction coding domain by using at least a long-term prediction on a first frequency-domain signal determined to be encoded in a time-based encoding mode;

a frequency-based encoding unit to perform frequency-based encoding in a frequency domain other than the linear prediction coding domain, on a second frequency-domain signal determined to be encoded in a frequency-based encoding mode; and a bitstream output unit to output encoded data, division information, and encoding mode information including the time-based encoding mode or the frequency-based encoding mode corresponding to each respective encoded frequency-domain signal.

2. The apparatus of claim 1, wherein the transformation & mode determination unit comprises:

a frequency-domain transform unit to transform the input audio signal into a full frequency-domain signal; and an encoding mode determination unit to divide the full frequency-domain signal into the frequency-domain signals according to a preset standard and to determine the time-based encoding mode or the frequency-based encoding mode for each respective frequency-domain signal.

3. The apparatus of claim 2, wherein the full frequency-domain signal is divided into the frequency-domain signals suitable for the time-based encoding mode or the frequency-based encoding mode based on at least one of a spectral tilt, a size of signal energy of each frequency domain, a change in signal energy between sub-frames, and a voicing level determination, and the respective encoding mode for each frequency-domain signal is determined accordingly.

4. The apparatus of claim 2, wherein the frequency-domain transform unit performs the frequency-domain transform using a frequency varying modulated lapped transform (MLT).

5. The apparatus of claim 1, wherein the time-based encoding unit selects the encoding mode for the first input frequency-domain signal based on at least one of a linear coding gain, a spectral change between linear prediction filters of adjacent frames, and a predicted pitch delay, continues to perform the time-based encoding on the first frequency-domain signal when the time-based encoding unit determines that the time-based encoding mode is suitable for the first frequency-domain signal, and stops performing the time-based encoding on the first frequency-domain signal and transmits a mode conversion control signal to the transformation & mode determination unit when the time-based encoding unit determines that the frequency-based encoding mode is suitable for the first frequency-domain signal, and the transformation & mode determination unit outputs the first frequency-domain signal again, which was provided to the time-based encoding unit, to the frequency-based encoding unit in response to the mode conversion control signal.

6. The apparatus of claim 1, wherein the time-based encoding unit quantizes a residual signal obtained from linear prediction and dynamically allocates bits to the quantized residual signal according to importance.

7. The apparatus of claim 6, wherein the importance is determined based on a voicing model.

8. The apparatus of claim 1, wherein the time-based encoding unit transforms a residual signal obtained from a linear prediction into a frequency-domain signal, quantizes the frequency-domain signal, and dynamically allocates bits to the quantized signal according to importance.

9. The apparatus of claim 8, wherein the importance is determined based on a voicing model.

10. The apparatus of claim 8, wherein the residual signal is obtained using a code excited linear prediction (CELP) algorithm.

11. The apparatus of claim 1, wherein the frequency-based encoding unit determines a quantization step size of an input frequency-domain signal according to a psychoacoustic model and quantizes the frequency-domain signal.

12. The apparatus of claim 1, wherein the frequency-based encoding unit extracts important frequency components from an input frequency-domain signal according to a psychoacoustic model, encodes the extracted important frequency components, and encodes remaining signals using noise modeling.

13. An adaptive time/frequency-based audio decoding apparatus, comprising:

a bitstream sorting unit to extract encoded data of at least one frequency band, and encoding mode information including a time-based encoding mode or a frequency-based encoding mode, of the at least one frequency band from an input bitstream;

a time-based decoding unit, implemented by at least one processing device, to perform a time-based decoding in a linear prediction coding domain by using at least a long-term prediction, on first encoded data based on the time-based encoding mode;

a frequency-based decoding unit to perform a frequency-based decoding in a frequency domain other than the linear prediction coding domain, on second encoded data based on the frequency-based encoding mode; and a collection & inverse transform unit to collect decoded data and to perform an inverse frequency-domain transform on the collected data.

14. The apparatus of claim 13, wherein the time-based decoding unit decodes the first encoded data using a CELP algorithm.

15. The apparatus of claim 13, wherein the collection & inverse transform unit performs envelope smoothing on the decoded data in the frequency domain and then performs the inverse frequency-domain transform on the decoded data such that the decoded data maintains continuity in the frequency domain.

16. The apparatus of claim 13, wherein a final audio signal is generated using a frequency-varying MLT after the decoded data is collected in the frequency domain.

17. An adaptive time/frequency-based audio encoding method, comprising:

dividing an input audio signal into a plurality of frequency-domain signals and selecting a time-based encoding mode or a frequency-based encoding mode for each respective frequency-domain signal;

performing a time-based encoding in a linear prediction coding domain by using at least a long-term prediction on a first frequency-domain signal determined to be encoded in the time-based encoding mode;

performing a frequency-based encoding in a frequency domain other than the linear prediction coding domain, on a second frequency-domain signal determined to be encoded in the frequency-based encoding mode; and outputting encoded data, division information, and encoding mode information including the time-based encoding mode or the frequency-based encoding mode of each respective frequency-domain signal.

18. The method of claim 17, wherein the division of the input audio signal comprises:

transforming the input audio signal into a full frequency-domain signal; and dividing the full frequency-domain signal into the frequency-domain signals according to a preset standard and selecting the time-based encoding mode or the frequency-based encoding mode for each respective frequency-domain signal.

19. The method of claim 18, wherein the division of the full frequency-domain signal comprises:

dividing the full frequency-domain signal into the frequency-domain signals suitable for the time-based encoding mode or the frequency-based encoding mode based on at least one of a spectral tilt, a size of signal energy of each frequency domain, a change in signal energy between sub-frames and a voicing level determination; and selecting the encoding mode for each respective frequency-domain signal.

20. An adaptive time/frequency-based audio decoding method, comprising:

extracting encoded data of at least one frequency band from an input bitstream, and encoding mode information including a time-based encoding mode or a frequency-based encoding mode, of the at least one frequency band;

performing a time-based decoding in a linear prediction coding domain by using at least a long-term prediction, on first encoded data based on the time-based encoding mode;

performing a frequency-based decoding in a frequency domain other than the linear prediction coding domain, on second encoded data based on the frequency-based encoding mode; and collecting decoded data and performing an inverse frequency-domain transform on the collected data.

21. A non-transitory computer-readable recording medium having a software program to execute an adaptive time/frequency-based audio encoding method, the method comprising:

dividing an input audio signal into a plurality of frequency-domain signals and selecting a time-based encoding mode or a frequency-based encoding mode of each respective frequency-domain signal;

performing a time-based encoding in a linear prediction coding domain by using at least a long-term prediction on a first frequency-domain signal determined to be encoded in the time-based encoding mode;

performing a frequency-based encoding in a frequency domain other than the linear prediction coding domain, on a second frequency-domain signal determined to be encoded in the frequency-based encoding mode; and outputting encoded data, division information, and encoding mode information including the time-based encoding mode or the frequency-based encoding mode, of each respective frequency-domain signal.

22. A method of decoding a bitstream including encoded data and encoding mode information for at least one frequency band, comprising:

extracting the encoded data of the at least one frequency band from the bitstream, and encoding mode information including a time-based encoding mode or a frequency-based encoding mode, of the at least one frequency band;

decoding the encoded data of the at least one frequency band in a linear prediction coding domain, by using at least a long-term prediction, based on the time-based encoding mode;

decoding the encoded data of the at least one frequency band in a frequency domain other than the linear prediction coding domain, based on the frequency-based encoding mode; and performing an inverse frequency-domain transform on the decoded data of the at least one frequency band.

23. An audio decoding method, comprising:

extracting encoded data from an input bitstream;

decoding first encoded data, by using a code excited linear prediction (CELP) with at least a long-term prediction, in a first domain based on a mode information of the encoded data;

decoding second encoded data by using an advanced audio coding (AAC), in a second domain based on the mode information of the encoded data;

inverse-transforming data decoded in the second domain; and generating a signal including the inverse-transformed data and the result of decoding in the first domain.

24. The method of claim 23, wherein the first and second domains comprise a frequency domain.

25. The method of claim 23, wherein the first and second domains are different from each other.

26. An audio decoding method, comprising:

extracting encoded data from an input bitstream;

decoding first encoded data, by using at least a long-term prediction, in a linear prediction coding domain based on a mode information of the encoded data;

decoding second encoded data in a frequency domain other than the linear prediction coding domain based on the mode information of the encoded data;

inverse-transforming data decoded in the frequency domain; and generating a signal including the inverse-transformed data and the result of decoding in the linear prediction coding domain.

27. The method of claim 26, wherein the second encoded data is decoded by using an advanced audio coding (AAC).

* * * * *